US008424555B2

(12) United States Patent
Wu

(10) Patent No.: US 8,424,555 B2
(45) Date of Patent: Apr. 23, 2013

(54) PUMP NOZZLE INCLUDING LEVER WITH IMPROVED OPERABILITY

(76) Inventor: Scott Wu, Taichung (TW)

( * ) Notice: Subject to any disclaimer, the term of this patent is extended or adjusted under 35 U.S.C. 154(b) by 189 days.

(21) Appl. No.: 13/090,333

(22) Filed: Apr. 20, 2011

(65) Prior Publication Data

US 2011/0290339 A1 Dec. 1, 2011

(30) Foreign Application Priority Data

May 25, 2010 (TW) ..... 99116650 A

(51) Int. Cl.
*F16K 15/20* (2006.01)

(52) U.S. Cl.
USPC ..... 137/231; 137/223

(58) Field of Classification Search ..... 137/231, 137/223, 270; 251/149.7
See application file for complete search history.

(56) References Cited

U.S. PATENT DOCUMENTS

| | | | | |
|---|---|---|---|---|
| 6,146,116 | A * | 11/2000 | Wu et al. | 417/569 |
| 7,658,596 | B2 | 2/2010 | Wu | |
| 2005/0252550 | A1* | 11/2005 | Wu | 137/231 |

FOREIGN PATENT DOCUMENTS

| | | | |
|---|---|---|---|
| DE | 19812961 | A1 | 5/1999 |
| DE | 10 2008 046865 | A1 | 3/2010 |
| TW | M328506 | | 3/2008 |

* cited by examiner

*Primary Examiner* — John Rivell
*Assistant Examiner* — Michael R Reid
(74) *Attorney, Agent, or Firm* — Alan Kamrath; Kamrath IP Lawfirm, P.A.

(57) ABSTRACT

A pump nozzle includes a housing body including a lateral edge. The lateral edge defines a valve connecting end and a lever connecting end. A lever is connected to the lever connecting end and is operably pivotal between a first position and a second position. Also, the lever includes a first extension and a second extension extending therefrom and angled thereto. When the lever is in the first position, its first extension is disposed in and adjacent to the lateral edge and is oriented towards the top edge of the housing body, and its second extension is disposed in and adjacent to the top edge and is orientated towards the valve connecting end of the housing body. When the lever is in the second position, the first and second extensions are disposed outside the lateral edge and top edge of the housing body, respectively.

13 Claims, 16 Drawing Sheets

PUMP NOZZLE INCLUDING LEVER WITH IMPROVED OPERABILITY

BACKGROUND OF THE INVENTION

1. Field of the Invention

The present invention relates to the field of air pumps and, in particular, to a lever designed for improved operability. The lever is mounted to a pump nozzle of the air pump and is operably moveable to a first position that enables a valve of an object to be inflated locked thereto and a second position that enables the valve to be released therefrom.

2. Description of the Related Art

A floor pump is an air pump that is commonly known. While the floor pump has the advantage of enabling the user to pump an item to be inflated in an efficient way, it needs a large storage space and carrying it is not easy. Therefore, it is not convenient for the user to carry a floor pump with him. Then, a portable air pump is invented and it becomes prevalent and finds favor with bicycle riders. Generally, a portable air pump includes a hose that is exposed outside the body of the portable pump and a footstand which is retractable. Then, a mini pump is invented. Generally, a mini pump has no hose that is attached to and exposed outside the body of the mini pump in order to achieve a compact volume. Moreover, a mini pump generally has a flush overall outlook. Therefore, a mini pump has the advantage of having an appealing appearance and it is convenient for the user to carry the mini pump with him.

As set forth, air pumps are classified into three categories: a floor pump, a mini pump and a frame floor pump. The floor pump generally has a large cylinder for allowing a large volume of air to be pumped out per stroke. Furthermore, the floor pump has a pedal and a handle and the user can step on the pedal and hold the handle during the operation of the floor pump. The mini pump has a smaller volume relative to the floor pump so that it is convenient and easy for the user to carry the mini pump. When operating the mini pump, the user grips a cylinder of the mini pump in one hand and grips a nozzle head of the mini pump in another hand. However, it is laborious to operate the mini pump because it does not provide a fulcrum during the operation thereof The frame floor pump combines the advantages of the floor pump and the mini pump. It has a footstand and a handle which can be pivoted from a position aligned with a cylinder of the frame floor pump to a position perpendicular to the cylinder during the operation of the frame floor pump, and user can step on the pedal and grip on the handle to achieve an effort-saving operation. Additionally, it has a small volume so that it can be carried easily.

Referring to FIGS. 15 and 16, an air pump 90, which is disclosed in DE102008046865 entitled to the inventor of the present invention, includes a pumping device 91 and a pump nozzle 92 connected to a distal end of the pumping device 91. The pump nozzle 92 includes a lever 93 pivotally connected thereto and including a distal end defining an operation end being operably pivotal away from the pumping device 91 to make a plunger device (not shown) disposed within the pump nozzle 92 to engage with a valve of an object to be inflated. Consequently, the object is adapted to be inflated. Upon the inflation, the valve is locked to the pump nozzle 92 and air is delivered to the plunger device and pumped to the object under the reciprocating movement of the pumping device 91. The pump nozzle 92 further includes an end cap 94 adapted for retaining the plunger device within the pump nozzle 92. While the operation end of the lever 93 is pivoted away from the pumping device 91 to engage a valve of a tire fit on a wheel of a bicycle, the lever 93 is moved towards spokes of the wheel, but the problem is that the spokes are liable to prevent and interfere with the user to pivot the lever 93 to cause the plunger device to engage with the valve. When the air pump is not in use, the operation end of the lever 93 is pivoted to a position adjacent to the pumping device 91 to make the air pump compact and easy to be carried. However, since the lever 93 is protruded from the pump nozzle 92 and entails an increased volume to an overall size of the air pump, the lever 93 is liable to obstruct fitting of the air pump to a bicycle. Additionally, none of the air pumps disclosed in TW M328506, DE102008003038, DE19812961 resolves the problem that spokes of a tire to be inflated interfere the user to pivot the lever to fixedly and fluidally engage with the tire.

The present invention is, therefore, intended to obviate or at least alleviate the problems encountered in the prior art.

DETAILED DESCRIPTION OF THE PREFERRED EMBODIMENTS

Figure 1:
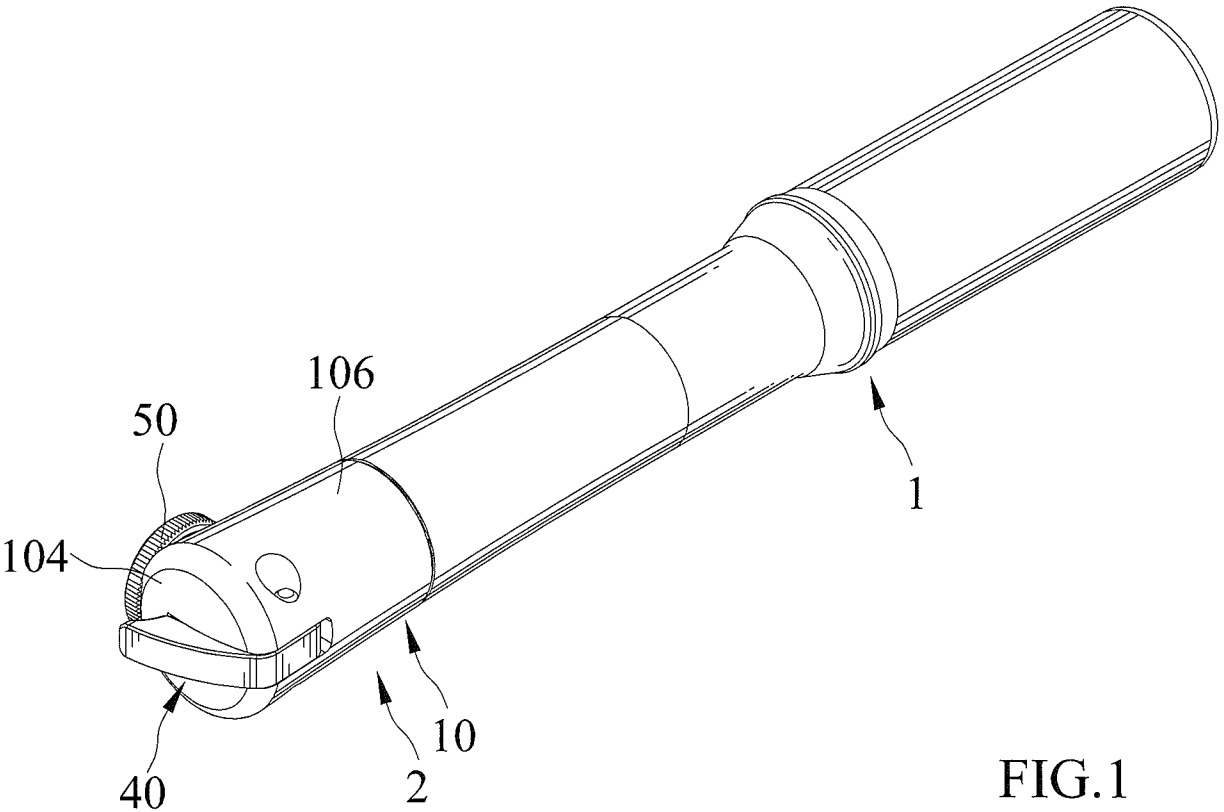
FIG. 1 is a perspective view of an air pump including a pump nozzle including a lever in accordance with a first embodiment of the present invention.
Figure 2:
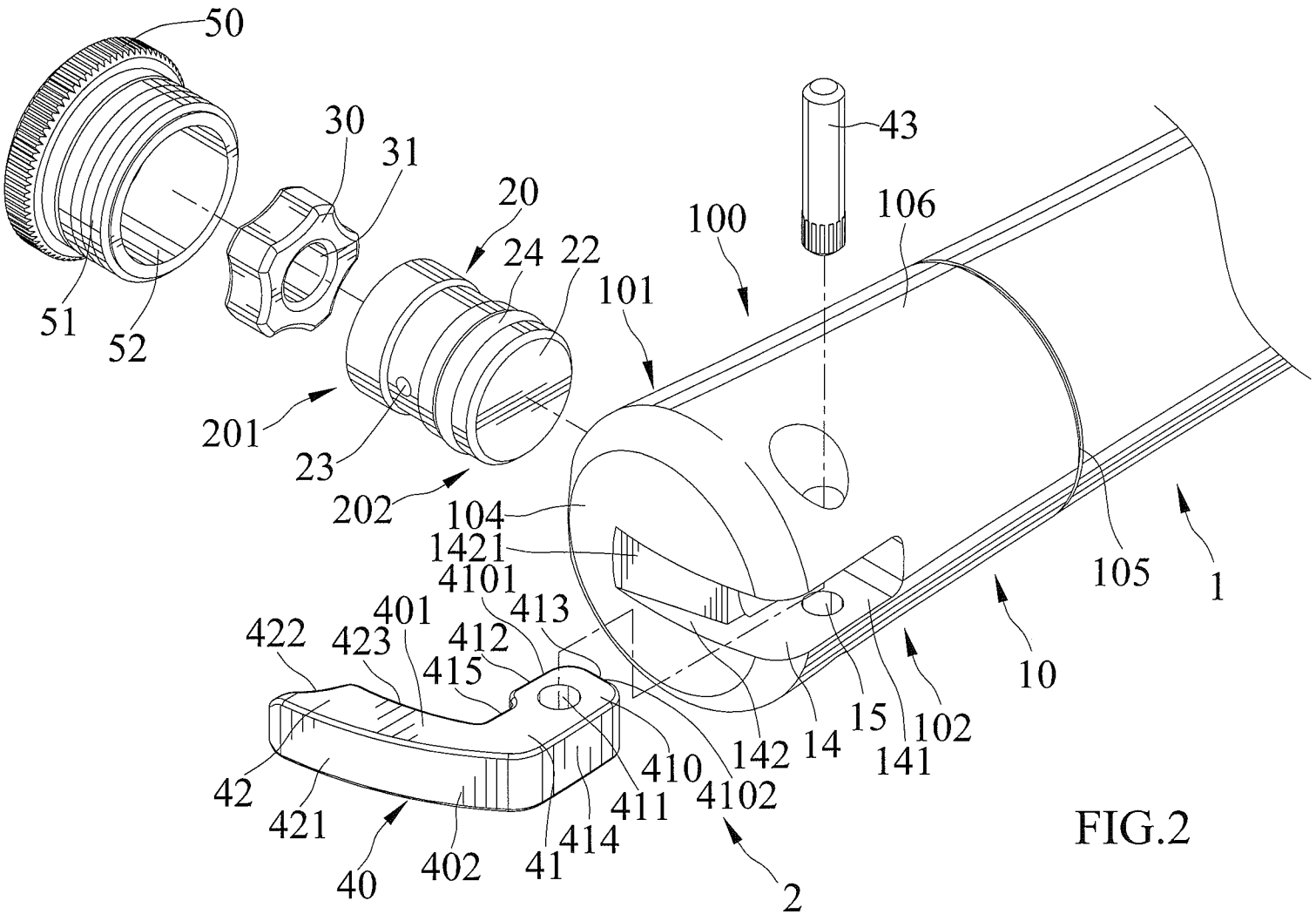
FIG. 2 is an exploded perspective view of the pump nozzle shown in FIG. 1.
Figure 3:
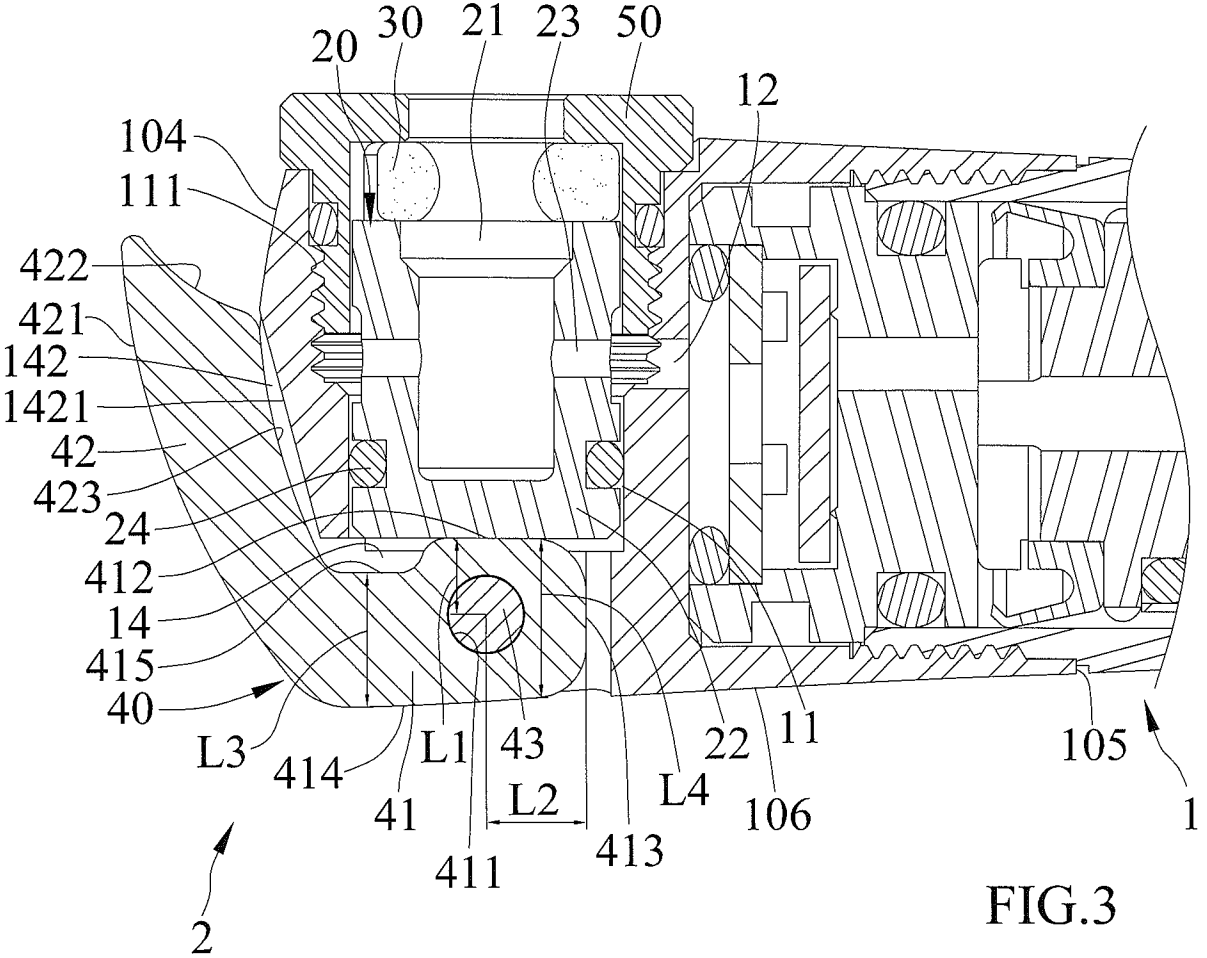
FIG. 3 is a cross-sectional view of the pump nozzle shown in FIG. 1.
Figure 4:
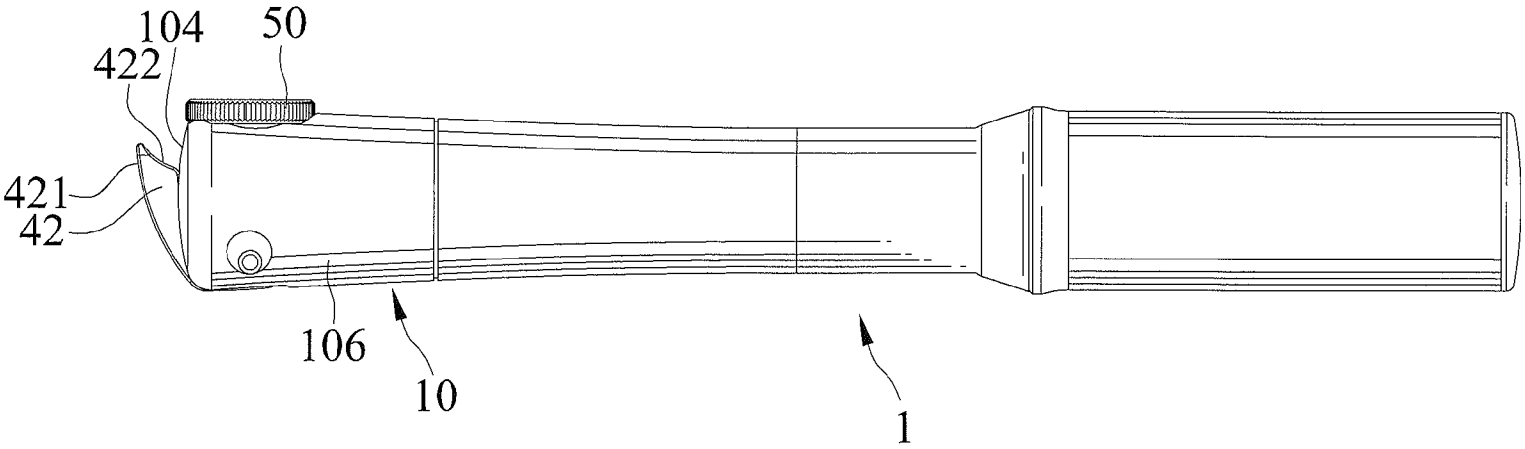
FIG. 4 is a side view showing the lever embodying the present invention shown in FIG. 1 in a first position.
Figure 5:
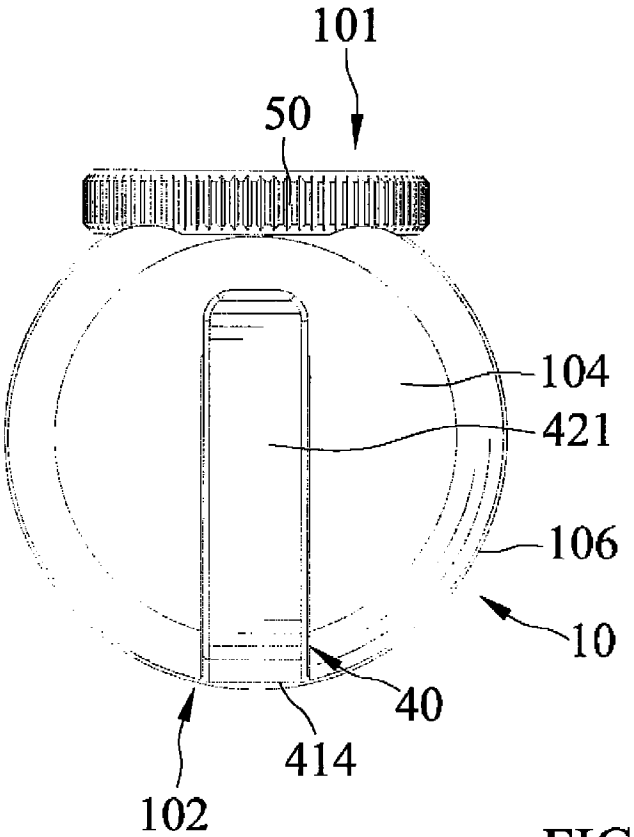
FIG. 5 is a front view showing the lever embodying the present invention shown in FIG. 1 in a first position.
Figure 6:
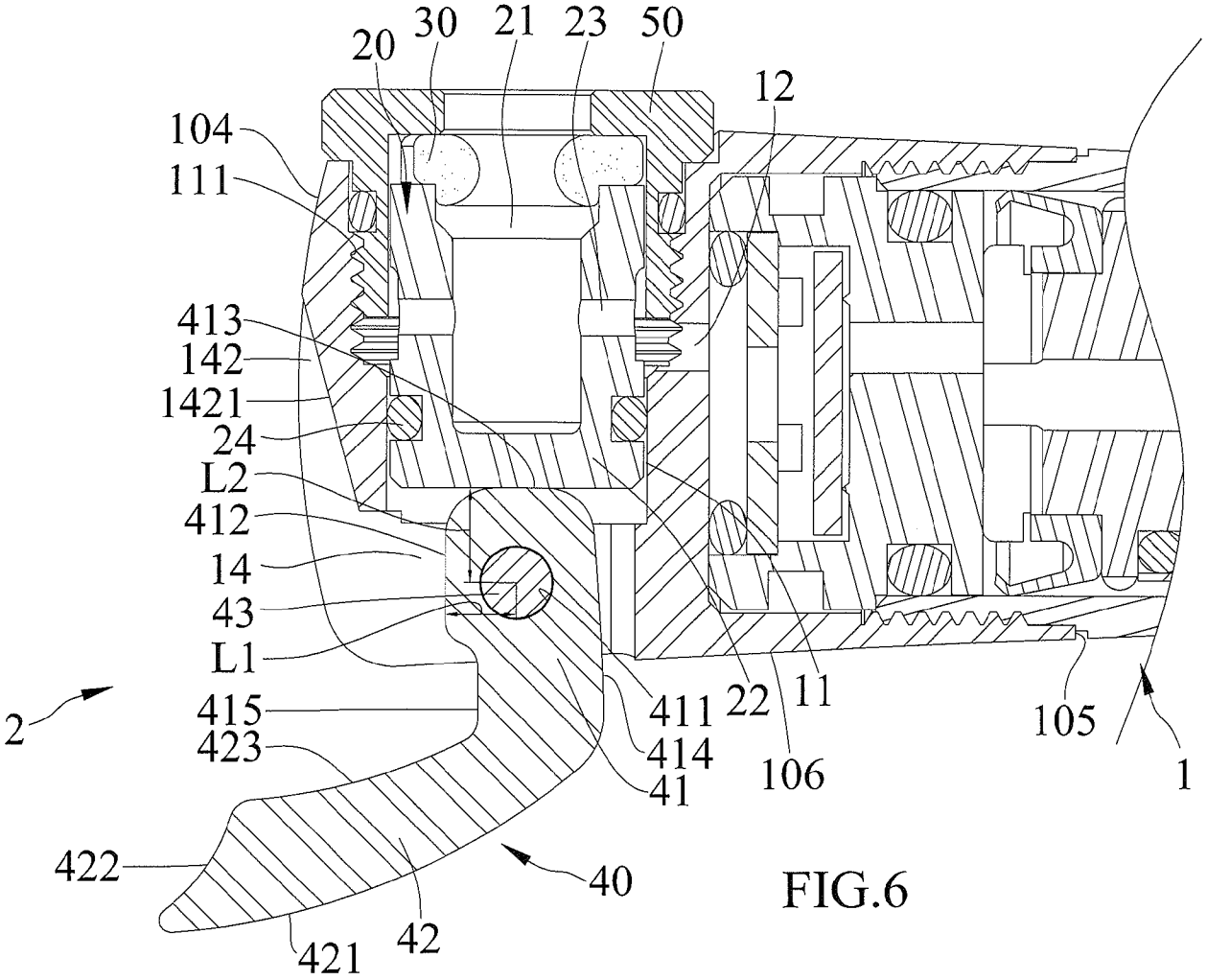
FIG. 6 is another cross-sectional view showing the pump nozzle embodying the present invention shown in FIG. 1 in a second position.
Figure 7:
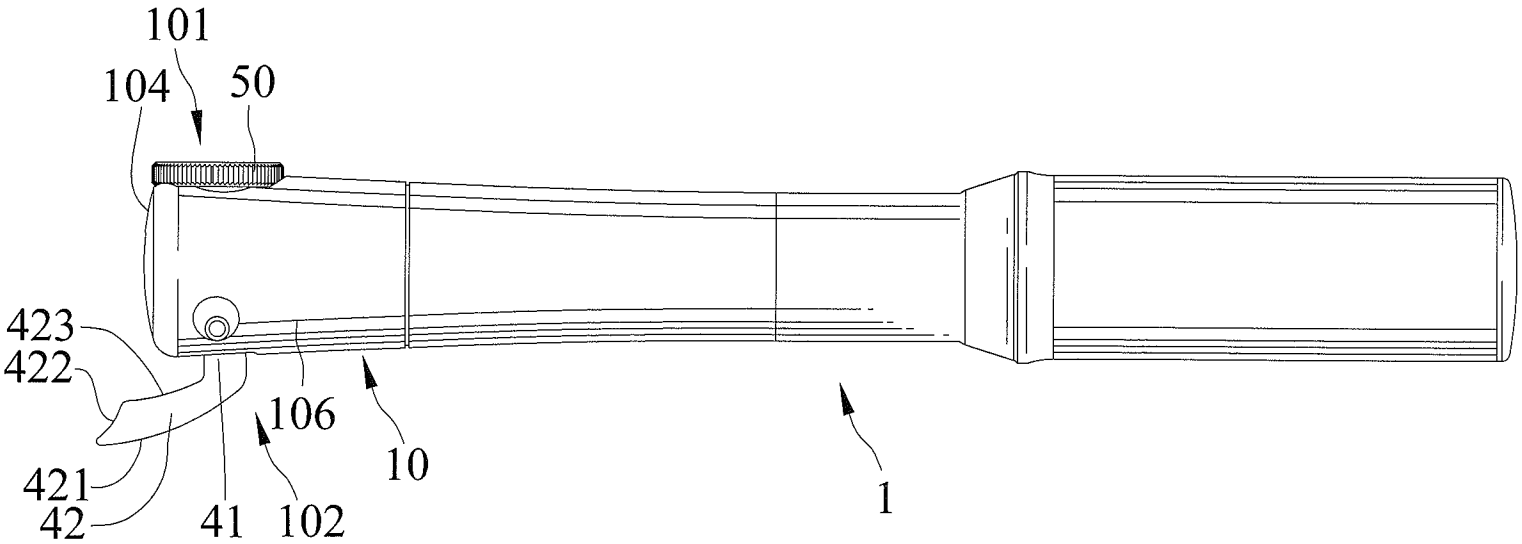
FIG. 7 is a side view showing the lever embodying the present invention shown in FIG. 1 in the second position.

FIGS. 1 through 10 show an air pump including a pumping device 1 and a pump nozzle 2 in accordance with a first embodiment of the present invention. The pumping device 1 includes two opposing distal ends including first and second distal ends. The pump nozzle 2 is connected to the first distal end of and in fluidal communication with pumping device 1. Additionally, the pumping device 1 includes chamber (not numbered) and a pumping mechanism (not numbered) connected to and adapted to be operably moved reciprocally with respect to the chamber so that air is induced to the chamber and pumped into the pump nozzle 2.

The pump nozzle 2 includes a housing body 10 connected to the first distal end of the pumping device 1. The housing body 10 includes an outer periphery 100 including a top edge 104, a bottom edge 105 in opposition to the top edge 104, and a lateral edge 106 extending from the top edge 104 to the bottom edge 105. The bottom edge 105 of the housing body 10 is abutted against the pumping device 1 and includes an outer diameter the same as an outer diameter of the first distal end of the pumping device 1 in order to obtain a flush and aligned outlook with the pumping device 1. The lateral edge 106 defines two opposing ends including a valve connecting end 101 and a lever connecting end 102. The housing body 10 further includes a channel 11 extending therethrough and from the valve connecting end 101 to the lever connecting end 102, and a passage 12 extending therein and communicating with the channel 11 and allowing air pumped from the pumping device 1 to flow pass and enter into the channel 11. Further, an inner thread 111 is defined in an inner periphery that delimits the channel 11 and on a first end thereof and adjacent to the valve connecting end 101. The housing body 10 yet further includes a slot 14 extending from the outer periphery 100 thereof and thereinto such that the slot 14 includes a space defined in the housing body 10 and including two opposing lateral sides and an L-shaped opening defined on the outer periphery 100. Specifically, the opening of the slot 14 includes a first section extending on the lateral edge 106 of the housing body 10 where the lever connecting end 102 is defined and a second section extending on the top edge 104 of the housing body 10. The space is utilized to accommodate a lever 40 of the pump nozzle 2. The lever 40 and its function will be further described hereafter. Further, a hole 15 is defined in the housing body 10 and communicates with the slot 14. The hole 15 is disposed adjacent to the lever connecting end 102 of the housing body 10 and defined within the outer periphery 100 of the housing body 10. Also, the hole 15 receives a pivot 43 of the lever 40 that pivotally connects the lever 40 to the housing body 10.

Furthermore, the slot 14 is not only disposed adjacent to the lever connecting end 102 but also disposed adjacent to a second end of the channel 11, which is opposed to the first end of the channel 11, and communicates with the channel 11 too. Moreover, the space of the slot 14 defines a first slot section 141 disposed behind the second end of the channel 11 and extending axially therefrom to the lateral edge 106 of the housing body 10 that defines the lever connecting end 102, and a second slot section 142 connected to the first slot section 141 and disposed above the channel 11 and extending axially from a wall that delimits an outer periphery of the channel 11 to the top edge 104 of the housing body 10. Also, the second slot section 142 is of a wedged shape and includes a slanted surface 1421, which is defined by the outer periphery of the channel 11, including a first distal end and a second distal end and extending from the first distal end to the second distal end. The first distal end of the second slot section 142 is defined on the top edge 104 of the housing body 10 and its second distal end is away from the top edge 104 of the housing body 10. Additionally, the second distal end of the second slot section 142 terminates at the second end of the channel 11.

The pump nozzle 2 further includes a plunger device 20 and a depressible gasket 30 disposed in the channel 11, and an end cap 50 retaining and preventing the plunger device 20 and depressible gasket 30 from dropping out of the channel 11. The end cap 50 is threadly engaged with the housing body 10 in that it includes an outer thread 51 formed on its outer periphery and engaged with the inner thread 111 defined on the channel 11. Also, the end cap 50 includes a bore 52 extending therethrough and communicating with the channel 11.

The plunger device 20 includes two terminals including a first terminal 201 and a second terminal 202 disposed in opposition to the first terminal 201. Further, a compartment 21 is defined in the plunger device 20 and extends from the first terminal 201 towards the second terminal 202. Further, an abutted end 22 is defined on the second terminal 202 of the plunger device 20 and abutted by the lever 40. Further, a passage 23 is defined in the plunger device 20 and communicates with the compartment 21. The passage 23 is also connected to the passage 12 of the housing body 10. Therefore, air pumped from the pumping device 1 is adapted to flow pass through the passages 12 and 23 and enter into the compartment 21. Moreover, the plunger device 20 includes a seal 24 mounted on its outer periphery and abutting against the inner periphery of channel 11 to stop air escaping from the second end of the channel 11.

The depressible gasket 30 is disposed between the plunger device 20 and the end cap 50 and includes an orifice 31 extending therethrough and aligned and communicating with the compartment 21 of the plunger device 20 and the bore 52 of the end cap 50. In the embodiment, the depressible gasket 30 is of a polygonal peripheral shape, however, other shapes can be contemplated.

The lever 40 includes a first extension 41 and a second extension 42 extending from an end of and angled to the first extension 41 such that the lever 40 is generally L shaped, and an outer periphery including two opposing first edges 401 and a second edge 402 extending between the two first edges 401. The second edge 402 extending on the first extension 41 defines first, second, third and fourth outer peripheral sections 412, 413, 414 and 415. The first and second outer peripheral sections 412 and 413 are adjacent to and perpendicular to each other. The first and fourth outer peripheral sections 412 and 415 are adjacent to each other and in opposition to the third outer peripheral section 414. The second edge 402 extending on the second extension 42 defines fifth, sixth, and seventh outer peripheral sections 421, 422 and 423. The fifth and seventh outer peripheral sections 421 and 423 are in opposition to each other, and the sixth outer peripheral section 422 interconnects a distal end of the fifth and seventh outer peripheral sections 421 and 423. The lever 40 further includes a cam structure 410 defined in the first extension 41 and including a first cam face 4101 defined on the first outer peripheral section 412 and a second cam face 4102 defined on the second outer peripheral section 413, respectively, and an aperture 411 extending through the related two opposing first edges 401. The first cam face 4101 is spaced from a center of the aperture 411 at a distance "L1". The second cam face 4102 is spaced from the center of the aperture 411 at a distance "L2". The distance "L1" is smaller than the distance "L2". Additionally, the third outer peripheral section 414 is spaced from the fourth outer peripheral section 415 at a distance "L3", and the first outer peripheral section 412 is spaced from the third outer peripheral section 414 at a distance "L4". The distance "L3" is smaller than the distance "L4" for the design of the cam structure 410.

Furthermore, the lever 40 is pivotally connected to the lever connecting end 102 of the housing body 10 and operably pivotal between a first position and a second position. When the lever 40 is in the first position thereof, its first extension 41 is disposed in and adjacent to the lateral edge 106 and is oriented towards the top edge 104 of the housing body 10, and its second extension 42 is disposed in and adjacent to the top edge 104 and is orientated towards the valve connecting end 101 of the housing body 10. Furthermore, its first extension 41 is in the first slot section 141 of the slot 14 such that the third outer peripheral section 414 thereof is flush with the lateral edge 106 of the outer periphery 100 of the housing body 10, its second extension 42 is disposed in the second slot section 142 of the slot 14 such that the sixth outer peripheral section 422 thereof is extended outside the second section of the opening of the slot 14, its two first edges 401 are disposed in the two lateral sides of the slot 14, respectively, and the first cam face 4101 of the cam structure 410 thereof is abutted against the abutted end 22 of the plunger device 20. Also, the fourth outer peripheral section 415 of the lever 40 does not contact with the abutted end 22, due to that the length "L3" is smaller than the length "L4". Consequently, since the first extension 41 of the lever 40 is not extended outside the opening of the slot 14, the lever 40 will not become liable to obstruct fitting of the air pump to a bicycle and the air pump would look streamlined and appealing and high-quality in appearance. Additionally, although not shown, the third outer peripheral section 414 defined on the first extension 41 of the lever 40 is disposed within the first slot section 141 of the slot 14 when the lever 40 is in the first position is within the scope of the invention. Moreover, when the lever 40 is in the second position thereof, its first and second extensions 41 and 42 are pivoted away from the lateral edge 106 and top edge 104 of the housing body 10, respectively. Furthermore, its first extension 41 is extended out of the opening of the slot 14, its second extension 42 is completely disposed outside the second section of the opening of the slot 14, and the second cam face 4102 of the cam structure 410 thereof is abutted against the abutted end 22 of the plunger device 20.

Figure 8:
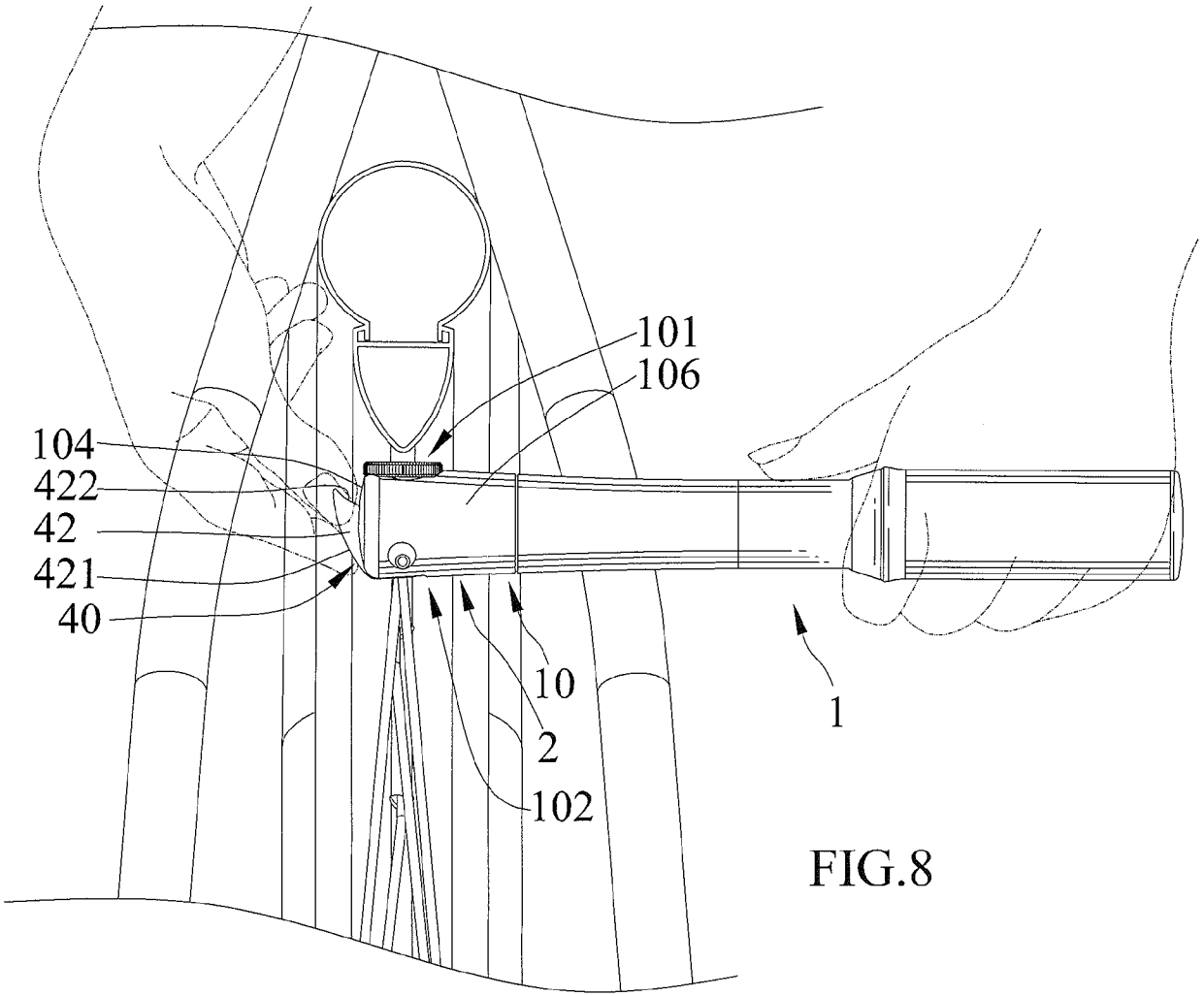
FIG. 8 shows the operation of the lever to cause the pump nozzle to lock and engage with a valve of a tire fit on a wheel of a bicycle.
Figure 9:
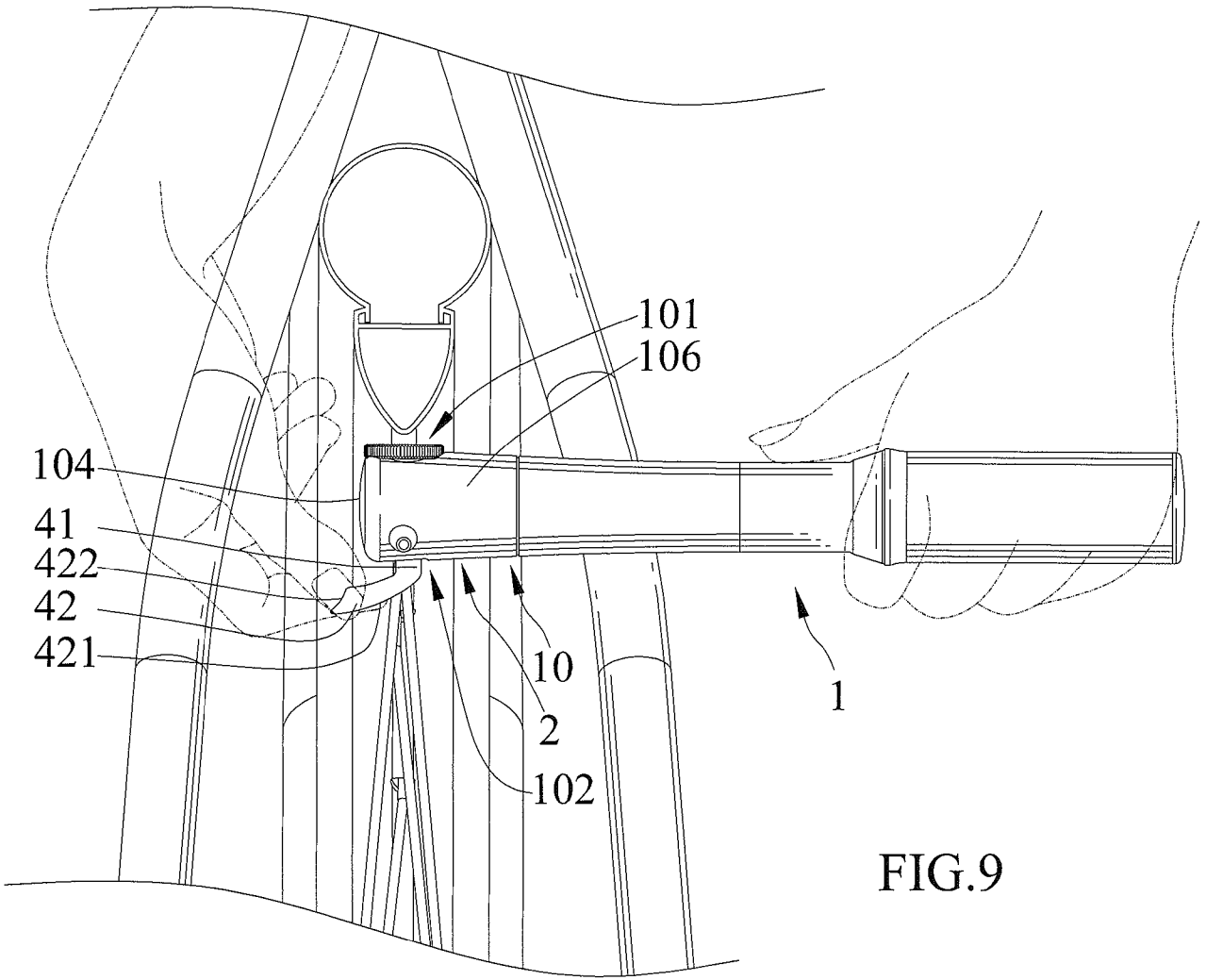
FIG. 9 is an extended view of FIG. 8.
Figure 10:
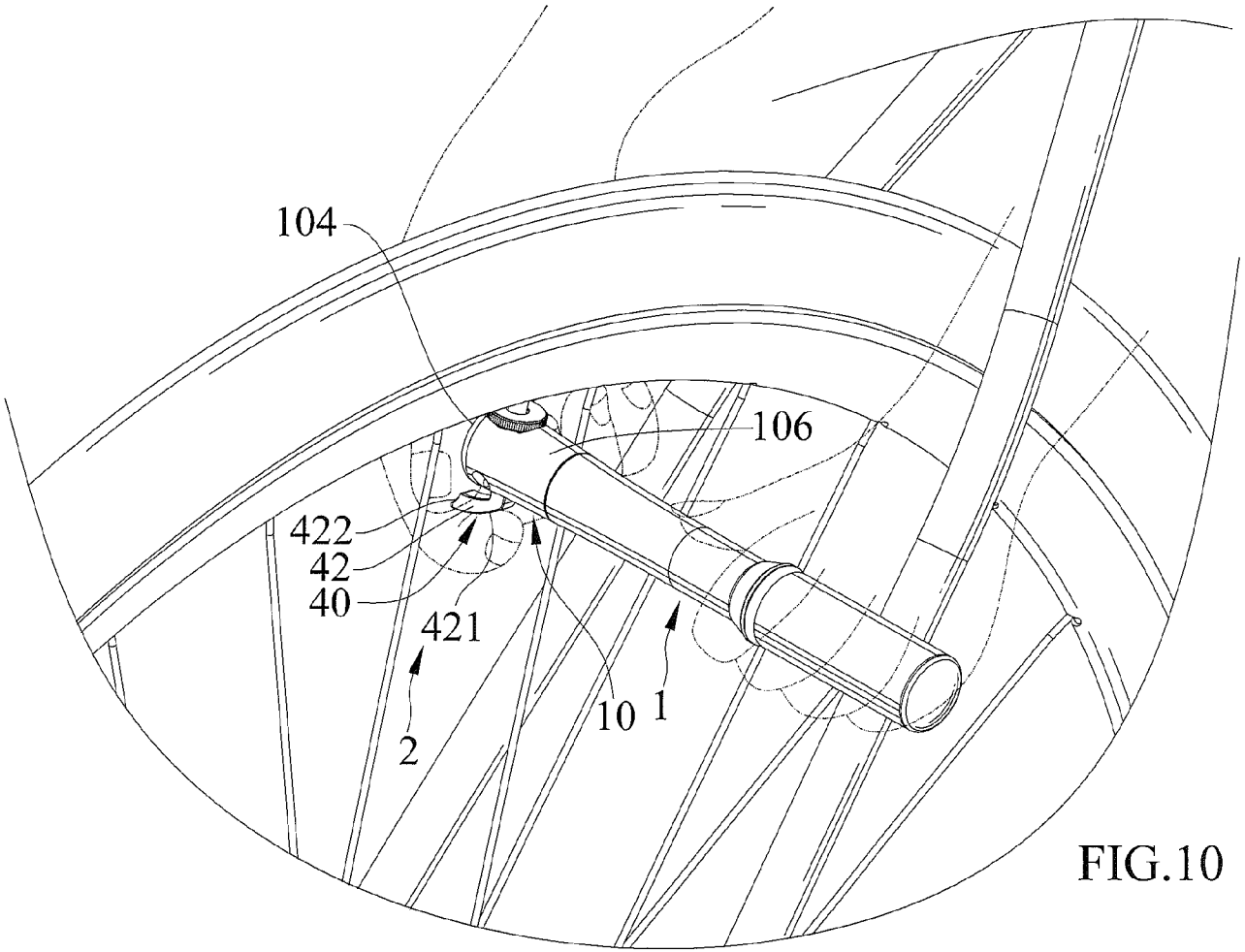
FIG. 10 is an extended view of FIG. 9.
Figure 11:
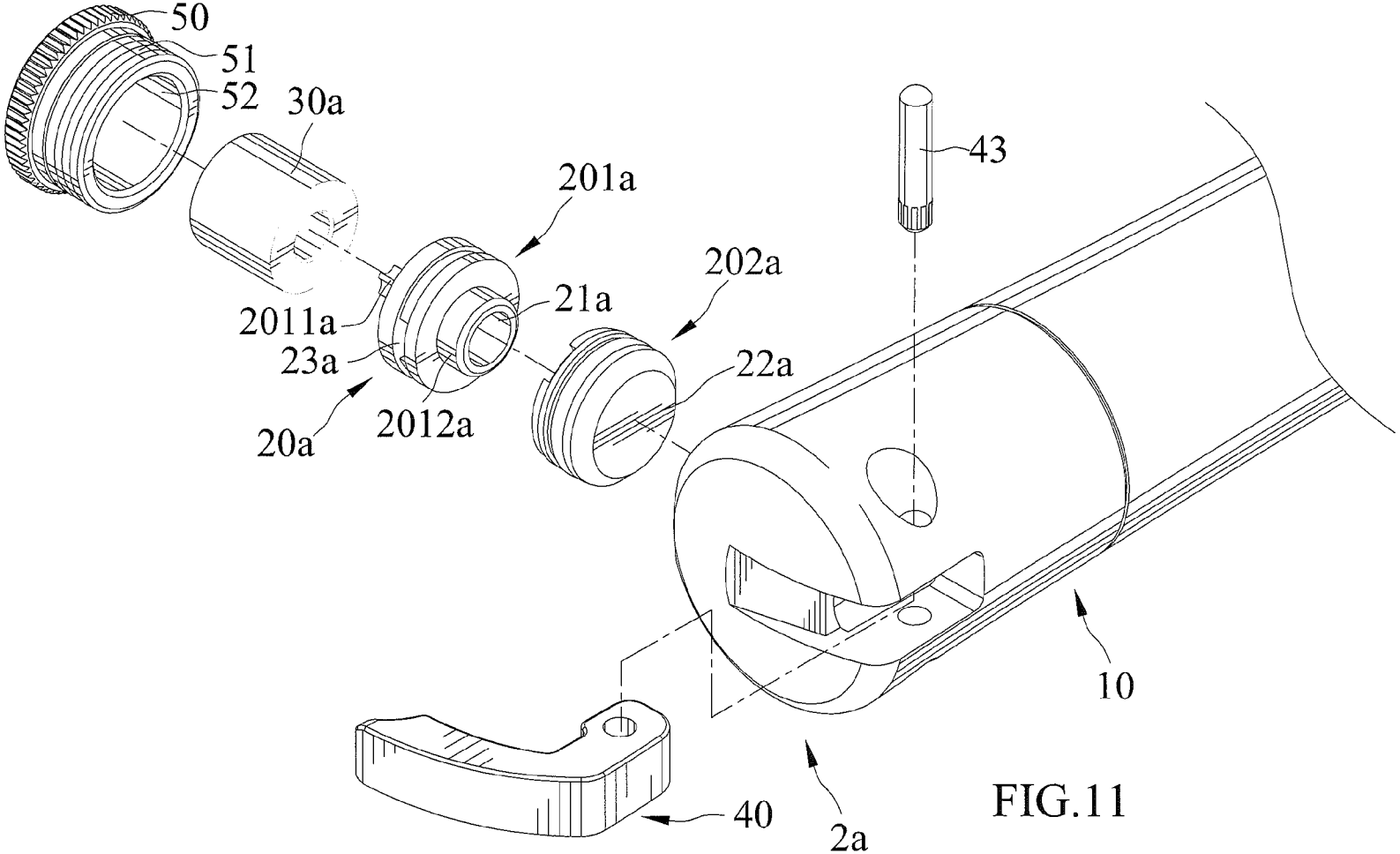
FIG. 11 is an exploded perspective view of a pump nozzle in accordance with a second embodiment of the present invention.
Figure 12:
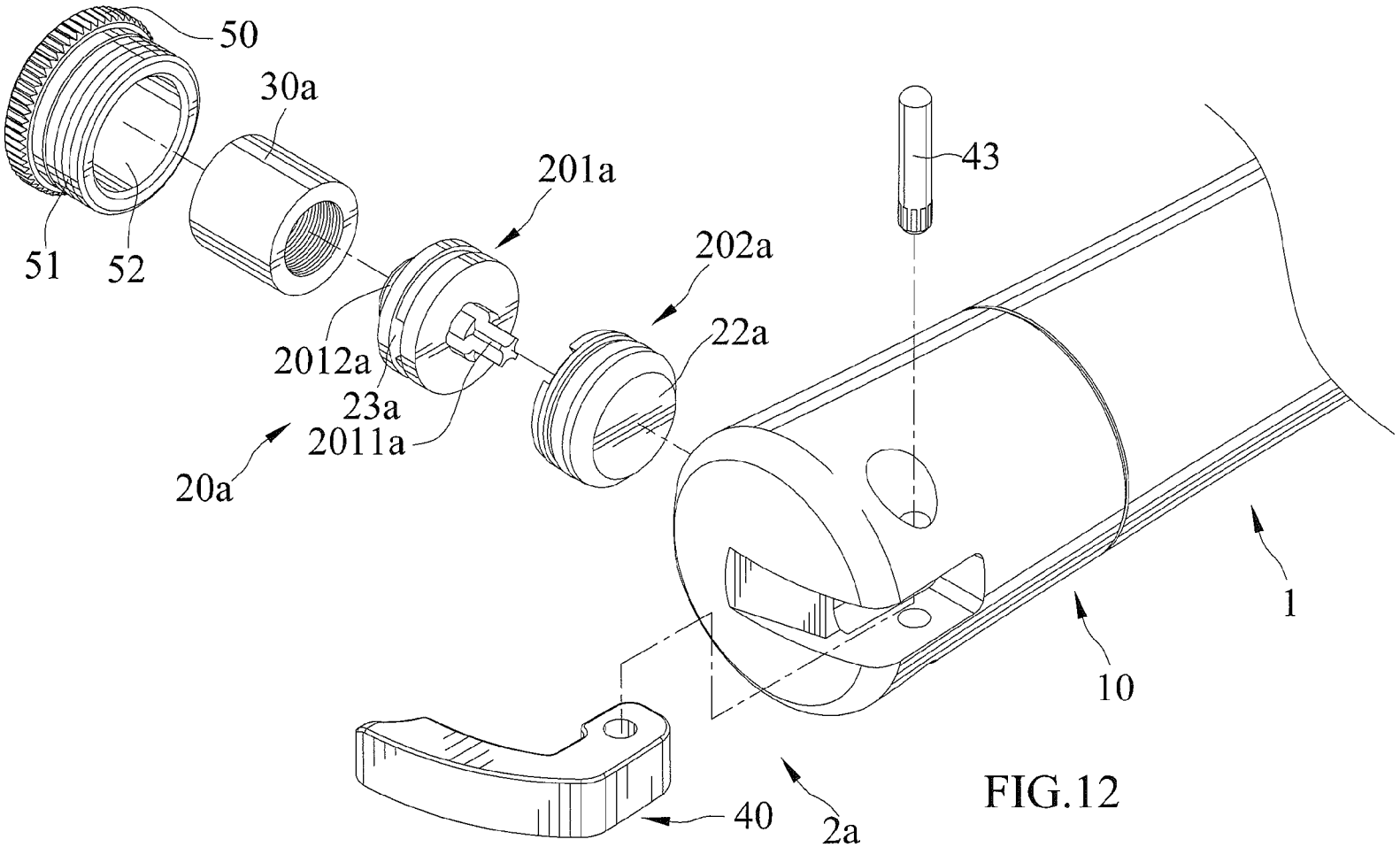
FIG. 12 is another exploded perspective view of the pump nozzle embodying the present invention shown in FIG. 11, viewed from a different angle.

In use of the air pump to inflate a valve of a tire fit on a wheel of a bicycle, the valve is connected to the pump nozzle 2 and the lever 40 is pivoted from the first position to the second position thereof thereafter. The sixth outer peripheral section 422 is extended outside the opening of the slot 14 when the lever 40 is in the first position such that the user can apply force to the sixth outer peripheral section 422 to pivot the lever 40. Referring to FIGS. 8 through 10, when the lever 40 is pivoted from the first position to the second position thereof, it is moved away from the spokes of the wheel to prevent the spokes from interfering with the user to pivot the lever 40. It is noted that when the lever 40 is pivoted to its second position, the sixth outer peripheral section 422 which the user urges is at a position that the spokes will not interfere with the user's fingers. After the lever 40 is in its second position, the plunger device 20 and the depressible gasket 30 are urged towards the first end of the channel 11, the depressible gasket 30 is depressed by the plunger device 20, and the valve is locked to the pump nozzle 2 in an air-tight manner, and by operating the pumping device 1 air is pumped to the pump nozzle 2 and into the object through the valve thereafter. Furthermore, after finishing with the inflating operation, the lever 40 is pivoted to the first position such that it urges the plunger device 20 and the depressible gasket 30 towards the second end of the channel 11 and the depressible gasket 30 is adapted to be resiliently returned to a non-depressed shape and the valve is adapted to be released from the pump nozzle 2.

Figure 13:
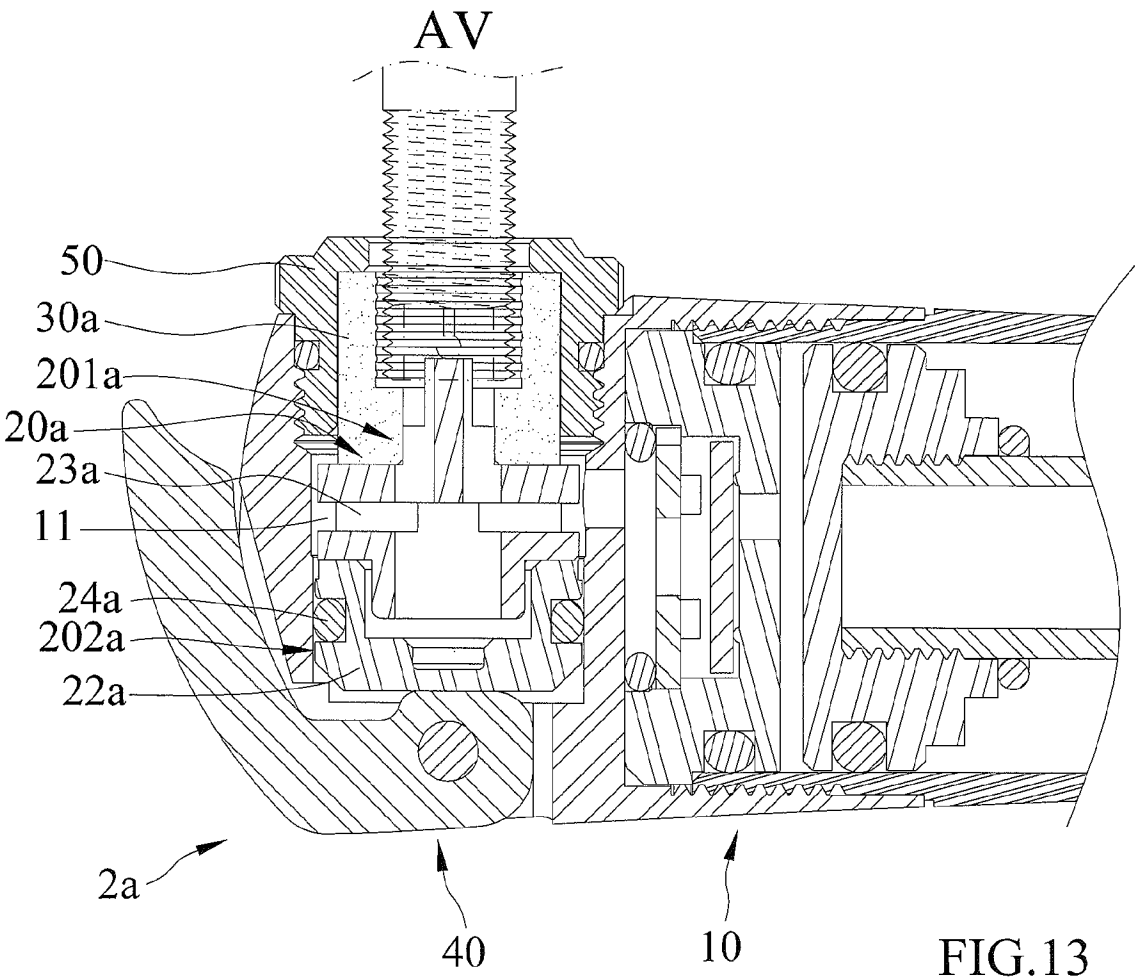
FIG. 13 shows an American valve engaged with the pump nozzle embodying the present invention shown in FIG. 11.
Figure 14:
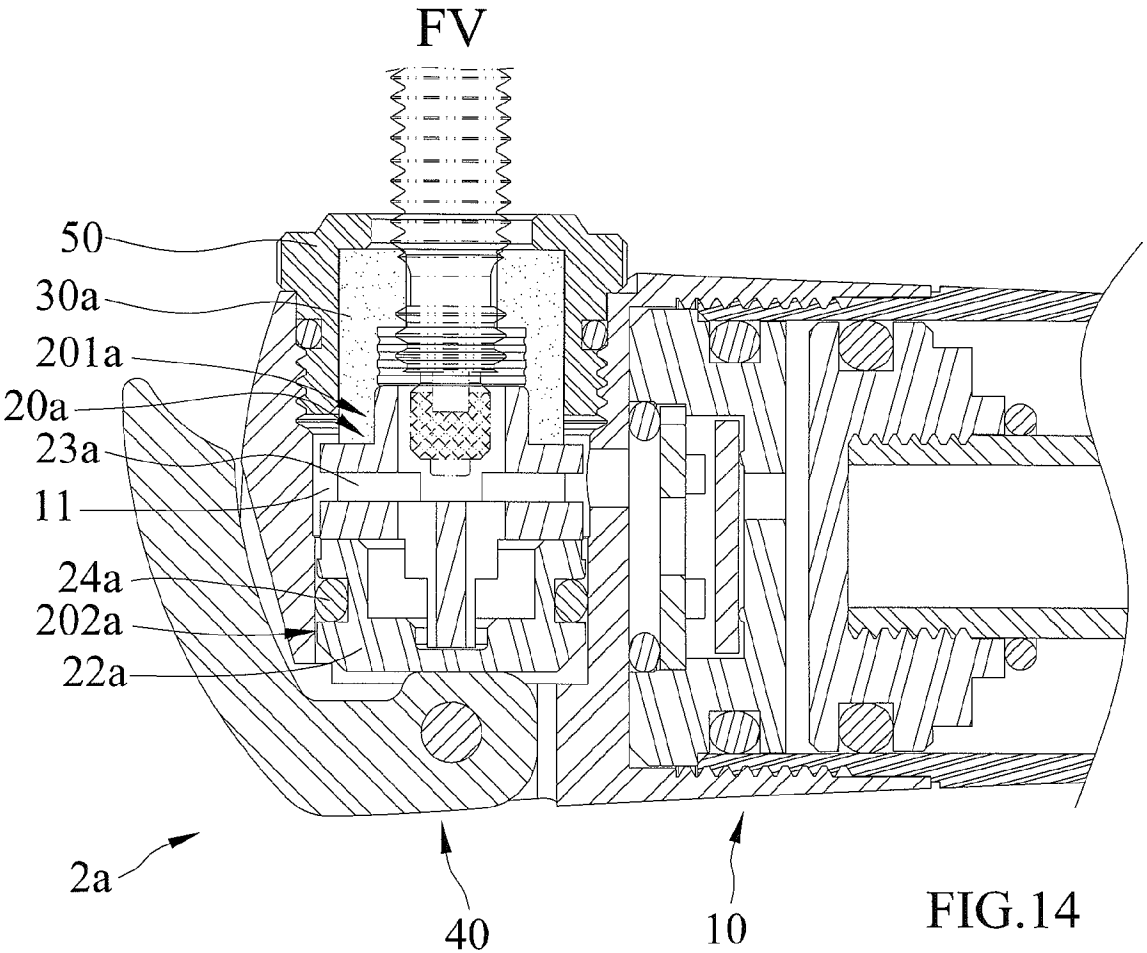
FIG. 14 shows a French valve engaged with the pump nozzle embodying the present invention shown in FIG. 11.
Figure 15:
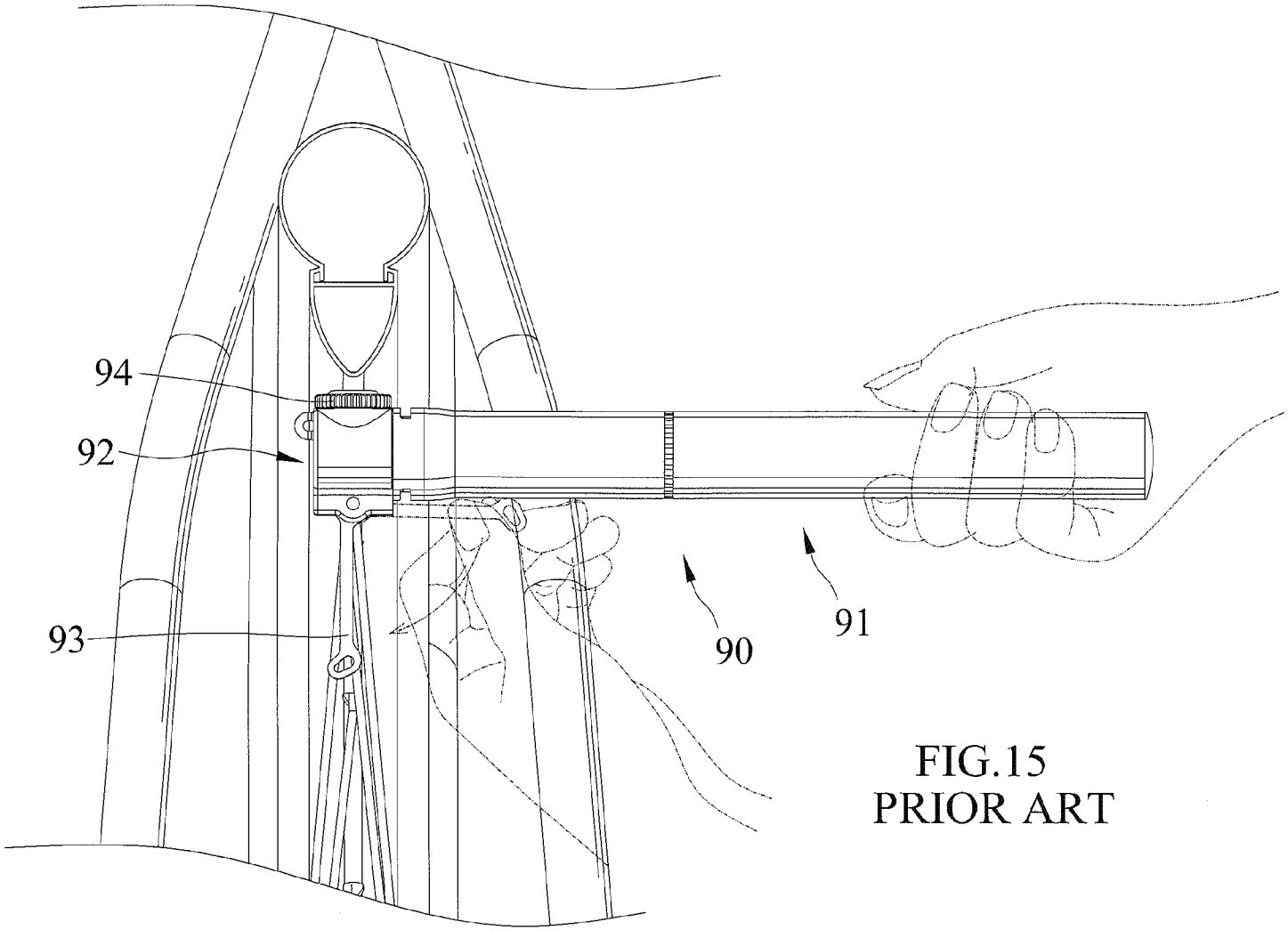
FIG.15 PRIOR ART
FIG. 15 shows the operation of a convention pump nozzle of an air pump locked and engaged with a valve of a tire fit on a wheel of a bicycle.
Figure 16:
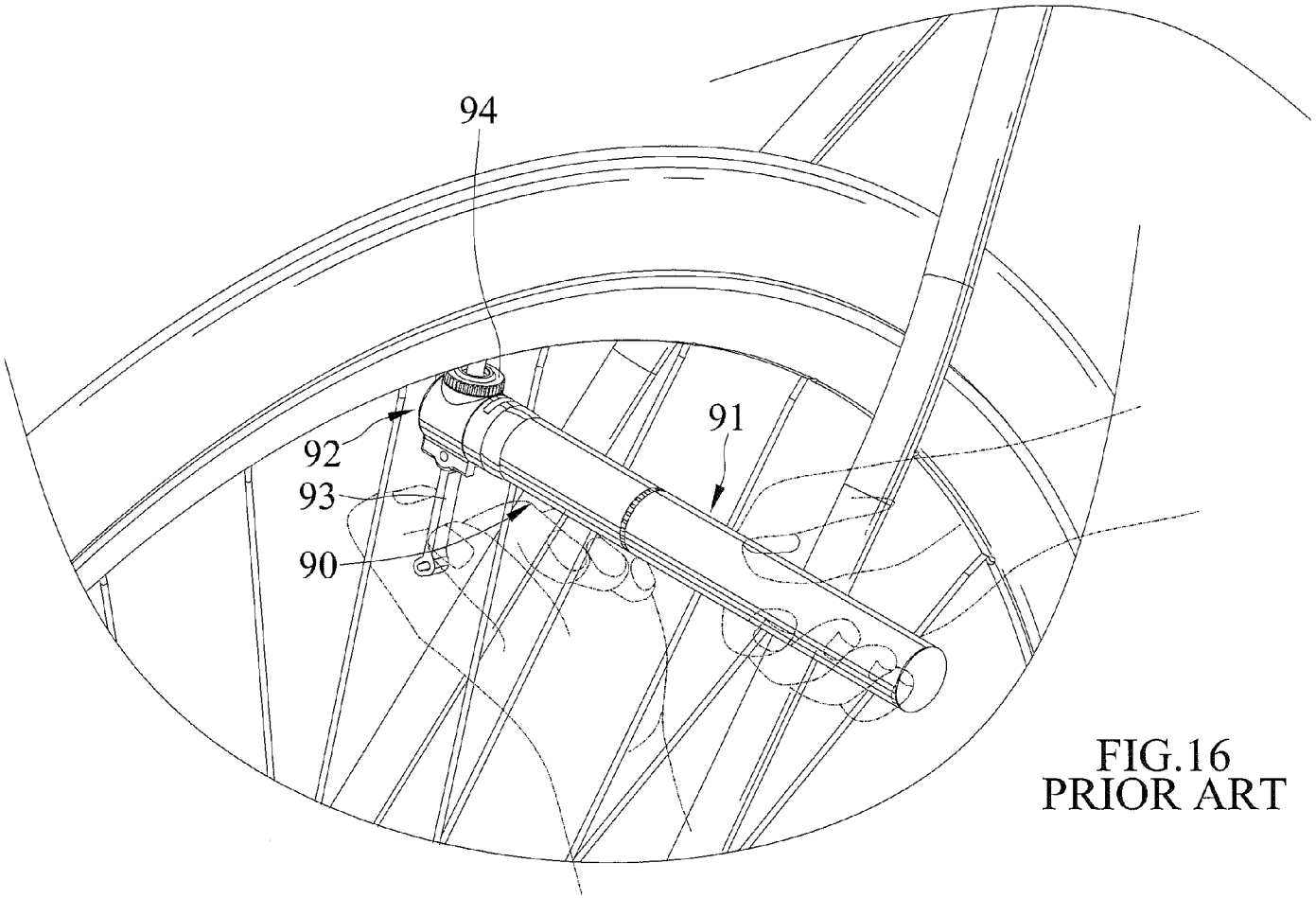
FIG. 16 PRIOR ART
FIG. 16 is an extended view of FIG. 15.

FIGS. 11 through 14 show a pump nozzle 2*a* in accordance with a second embodiment of the present invention, wherein like numerals are used to denote like components of the first embodiment, however, bearing a suffix "a". The pump nozzle 2*a* differentiates from the pump nozzle 2 in that it includes a plunger device 20*a* including a first terminal 201*a* and a second terminal 202*a* releasably engaged with and disposed in opposition to the first terminal 201*a*. Further, a compartment 21*a* and a passage 23*a* are defined in the first terminal 201*a* of the plunger device 20*a*. Further, an abutted end 22*a* is defined on an end of the second terminal 202*a*. Additionally, the first terminal 201*a* includes two opposing engaging ends including a first engaging end 2011*a* and a second engaging end 2012*a*. The first and second engaging ends 2011*a* and 2012*a* are designed for American and French valves, respectively. As shown in FIG. 13, when a valve of a tire is an American valve, the second engaging end 2012*a* of the first terminal 201*a* is engaged in the second terminal 202*a*, and the first engaging end 2011*a* is utilized to engage with the American valve. As shown in FIG. 14, when a valve of a tire is a French valve, the first engaging end 2011*a* of the first terminal 201*a* is engaged in the second terminal 202*a*, and the second engaging end 2011*a* is utilized to engage with the French valve. Moreover, the pump nozzle 2*a* includes a depressible gasket 30*a* of a circular peripheral shape.

In view of the forgoing, when the lever 40 is pivoted from the first position to the second position thereof, it is moved away from the spokes of the wheel, thereby preventing the spokes from interfering with the user to pivot the lever 40. Also, when the lever 40 is pivoted to its second position, the sixth outer peripheral section 422 which the user urges is at a position that the spokes will not interfere with the user's fingers. Additionally, when the lever 40 is in the first position, the first extension 41 thereof is not extended outside the opening of the slot 14. Consequently, the lever 40 will not become liable to obstruct fitting of the air pump to a bicycle and the air pump look streamlined and appealing and high-quality in appearance. Furthermore, the sixth outer peripheral section 422 defined on the second extension 42 of the lever 40 is extended outside the opening of the slot 14 such that the user can apply force to the sixth outer peripheral section 422 to pivot the lever 40.

While the specific embodiments have been illustrated and described, numerous modifications come to mind without significantly departing from the spirit of invention, and the scope of invention is only limited by the scope of the accompanying claims.

What is claimed is:

1. A pump nozzle of an air pump fluidly connectable to a valve of a tire fit on a wheel of a bicycle, comprising:

a housing body including an outer periphery including a top edge, a bottom edge in opposition to the top edge, and a lateral edge extending from the top edge to the bottom edge and defining two opposing ends including a valve connecting end and a lever connecting end respectively, and a slot extending from the outer periphery thereof and thereinto, wherein the slot includes a space defined in the housing body and including a first slot section and a second slot section connected thereto, with the space including an opening which includes a first section extending on the lateral edge where the lever connecting end is defined and a second section extending on the top edge of the housing body;

a plunger device disposed in the housing body;

a gasket disposed in the housing body;

a lever pivotally connected to the lever connecting end of the housing body and operably pivotal between a first position and a second position, with the lever including a first extension and a second extension extending from an end of and angled with respect to the first extension, with the lever pivotal about an axis defined on the first extension; and an end cap engaged with the housing body and retaining the plunger device and the gasket therein;

wherein when the lever is in the first position, the first extension is disposed in and adjacent to the lateral edge and is oriented towards the top edge of the housing body, wherein the second extension is disposed in and adjacent to the top edge and is oriented towards the valve connecting end of the housing body; wherein when the lever is in the second position, the first and second extensions are pivoted away from the lateral edge and the top edge of the housing body, respectively; and wherein the first and second extensions are received in the first and second slot sections of the slot, respectively when the lever is in the first position; and wherein in use of the air pump to inflate the tire, the lever is in the second position and the first and second extensions are disposed outside the lateral edge and the top edge of the housing body, respectively.

2. The pump nozzle as claimed in claim 1, wherein the bottom edge of the housing body is abutted against the pumping device and includes an outer diameter the same as an outer diameter of the distal end of the pumping device in order to obtain a flush and aligned outlook with the pumping device.

3. The pump nozzle as claimed in claim 1, wherein the housing body includes a channel defined therein and including a first end and a second end opposed from the first end, wherein the second end of the channel is disposed adjacent to the lever connecting end, and wherein the plunger device includes a seal mounted on an outer periphery thereof and abutting against an inner periphery of the channel to stop air from escaping from the second end of the channel.

4. The pump nozzle as claimed in claim 1, wherein the lever includes an outer periphery including two opposing first edges and a second edge extending between the two first edges, with the second edge extending on the first extension defining first, second, third and fourth outer peripheral sections, with the second edge extending on the second extension defining fifth, sixth, and seventh outer peripheral sections, with the first and second outer peripheral sections adjacent to each other, with the first and fourth outer peripheral sections adjacent to each other and opposed from the third outer peripheral section, with the fifth and seventh outer peripheral sections opposed from each other, and with the sixth outer peripheral section interconnecting a distal end of the fifth and seventh outer peripheral sections.

5. The pump nozzle as claimed in claim 4, wherein the lever includes a cam structure including a first cam face defined on the first outer peripheral section and a second cam face defined on the second outer peripheral section, respectively.

6. The pump nozzle as claimed in claim 5, wherein the cam structure includes an aperture extending through the related two opposing first edges, wherein the first cam face is spaced from a center of the aperture at a distance "L1", wherein the second cam face is spaced from the center of the aperture at a distance "L2", wherein and the distance "L1" is smaller than the distance "L2".

7. The pump nozzle as claimed in claim 6, wherein the first cam face of the cam structure is abutted against the plunger device when the lever is in the first position, wherein the plunger device and the gasket are urged towards the first end of the channel, wherein the second cam face of the cam structure is abutted against the plunger device when the lever is in the second position, and wherein the plunger device and the gasket are urged towards the second end of the channel.

8. The pump nozzle as claimed in claim 4, wherein when the lever is in the first position, the third outer peripheral section defined on the first extension is within the opening of the slot or is flush with the lateral edge of the outer periphery of the housing body.

9. The pump nozzle as claimed in claim 5, wherein when the lever is in the first position, the third outer peripheral section defined on the first extension is within the opening of the slot or is flush with the lateral edge of the outer periphery of the housing body.

10. The pump nozzle as claimed in claim 6, wherein when the lever is in the first position, the third outer peripheral section defined on the first extension is within the opening of the slot or is flush with the lateral edge of the outer periphery of the housing body.

11. The pump nozzle as claimed in claim 7, wherein when the lever is in the first position, the third outer peripheral section defined on the first extension is within the opening of the slot or is flush with the lateral edge of the outer periphery of the housing body.

12. The pump nozzle as claimed in claim 4, wherein the sixth outer peripheral section defined on the second extension of the lever is extended outside the opening of the slot, wherein the user applies force to the sixth outer peripheral section to pivot the lever.

13. The pump nozzle as claimed in claim 1, wherein the plunger device includes a first terminal and a second terminal releasably engaged with and disposed in opposition to the first terminal, wherein the first terminal includes a first engaging end and a second engaging end designed for American and French valves, respectively, and wherein when an American valve is engaged with the pump nozzle, the second engaging end of the first terminal is engaged in the second terminal and the first engaging end is utilized to engage with the American valve, and when a French valve is engaged with the pump nozzle, the first engaging end of the first terminal is engaged in the second terminal and the second engaging end is utilized to engage with the French valve.

* * * * *